US005486913A

United States Patent [19]

Aharon

[11] Patent Number: 5,486,913

[45] Date of Patent: Jan. 23, 1996

[54] BORESIGHT ASSEMBLY

[75] Inventor: Oren Aharon, Commack, N.Y.

[73] Assignee: PLX, Inc., Deer Park, N.Y.

[21] Appl. No.: 150,416

[22] Filed: Nov. 10, 1993

[51] Int. Cl.[6] ..... G01B 11/26; F41G 1/54

[52] U.S. Cl. ..... 356/153; 33/234

[58] Field of Search ..... 356/152–154, 356/253, 255, 139.01–139.04; 33/233–234

[56] References Cited

U.S. PATENT DOCUMENTS

| | | | |
|---|---|---|---|
| 2,476,981 | 7/1949 | Horton | 33/234 |
| 4,095,347 | 6/1978 | Steffan | 33/234 |
| 4,142,799 | 3/1979 | Barton | 356/153 |

OTHER PUBLICATIONS

Tasco Sports Optics Catalog, p. 23, 1990.

*Primary Examiner*—Richard A. Rosenberger
*Assistant Examiner*—K. P. Hantis
*Attorney, Agent, or Firm*—Michael R. Gilman; Gottlieb, Rackman & Reisman

[57] ABSTRACT

The boresight is comprised of a caliber rod having extending therefrom a reflecting member. The reflecting member has at least one reflecting surface; the reflecting surface being in either a fixed substantially perpendicular orientation to a longitudinal axis through the rod, or able to be adjusted to any desired angle with the axis of the rod. The rod is adapted to be removably slidable, and rotatable, within a muzzle of a bore of a weapon, while it is also constructed to fit snugly within the bore. The boresight may also comprise a beam splitter mirror for gathering light into the aiming device of the weapon. The muzzle of the weapon and the aiming device of the weapon are aligned when the aiming device or reticle (cross-hairs) of the aiming device and the reflection of the aiming device or reticle of the aiming device seen on the reflecting member coincide. The boresight also comprises a self-testing apparatus for testing the perpendicularity of the reflecting surface so as to accurately achieve alignment of the aiming device and the bore of the weapon.

19 Claims, 5 Drawing Sheets

BORESIGHT ASSEMBLY

BACKGROUND OF THE INVENTION

This invention relates to the field of boresights, and more particularly, to a boresight for a muzzle of a weapon.

Boresights are old in the art. Since the hit probability of a weapon is strongly dependent on the proper alignment of the weapon's muzzle to the aiming device mounted on the weapon, boresights have been used to achieve proper alignment.

A boresight made in accordance with the prior art, usually consists of an expensive telescope mounted on a calibre rod. For boresighting, the boresight is inserted into the weapons's bore. The user of the weapon will then undergo the following steps to align the muzzle and aiming device of the weapon: (1) aim the boresight telescope to a point on an external target; and (2) move his position and look through the aiming device on the weapon to align that aiming device to the same exact point on the external target.

These two steps require that (1) for the weapon to be aligned, an external target must be used, and (2) the user shift his eye position from the first position to the second position which is time consuming and tedious, and frequently inaccurate due to accidental movement of the weapon while adjusting.

Accordingly, it would be desirable to provide a boresight assembly through which the user of a weapon can align the weapon without the need of an external target and without having to move between separately aligning the telescope on the boresight and then the aiming device of the weapon.

SUMMARY OF THE INVENTION

In accordance with the invention, an improved boresight is provided.

The boresight is comprised of a calibre rod having extending therefrom a reflecting member. The reflecting member has at least one reflecting surface; the reflecting surface being in either a fixed substantially perpendicular orientation to a longitudinal axis through the rod, or able to be adjusted to any desired angle with the axis of the rod. The rod is adapted to be removably slidable, and rotatable, within a muzzle of a bore of a weapon, while it is also constructed to fit snugly within the bore. The boresight may also comprise a beam splitter mirror for gathering light into the aiming device of the weapon. The muzzle of the weapon and the aiming device of the weapon are aligned when the aiming device or reticle (cross-hairs) of the aiming device and the reflection of the aiming device or reticle of the aiming device seen on the reflecting member coincide. The boresight also comprises a self-testing apparatus for testing the perpendicularity of the reflecting surface so as to accurately achieve alignment of the aiming device and the bore of the weapon.

Accordingly, it is an object of the invention to provide an improved boresight assembly.

Another object of the invention is to provided a boresight assembly having a reflecting member mounted perpendicularly to the longitudinal axis of a calibre rod, which is inserted into the muzzle of the weapon.

A further object of the invention is to provide a boresight assembly which needs only one alignment position to align the muzzle of the weapon and the aiming device of the weapon.

Yet a further object of the invention is to provide an improved boresight assembly which needs no external target in order to align the weapon.

Still another object of the invention is to provide an improved boresight assembly having a built-in self-testing apparatus for testing perpendicularity of the boresight to the weapon so as to achieve alignment of the weapon.

Yet another object of the invention is to provide a boresight assembly having a beam splitter mirror to gathering light into the aiming device of the weapon.

Other objects of the invention will in part be obvious and will in part be apparent from the following description.

The invention accordingly comprises an assembly possessing the features, properties and the relations of components which will be exemplified in the products hereinafter described, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 2:
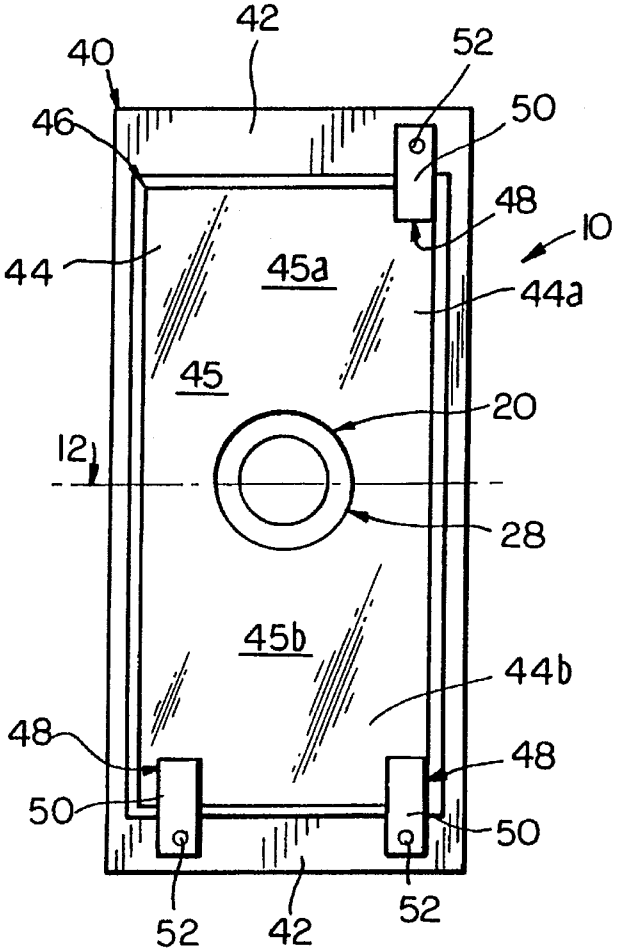
FIG. 2 is a front elevational view of the boresight assembly of FIG. 1.
Figure 1:
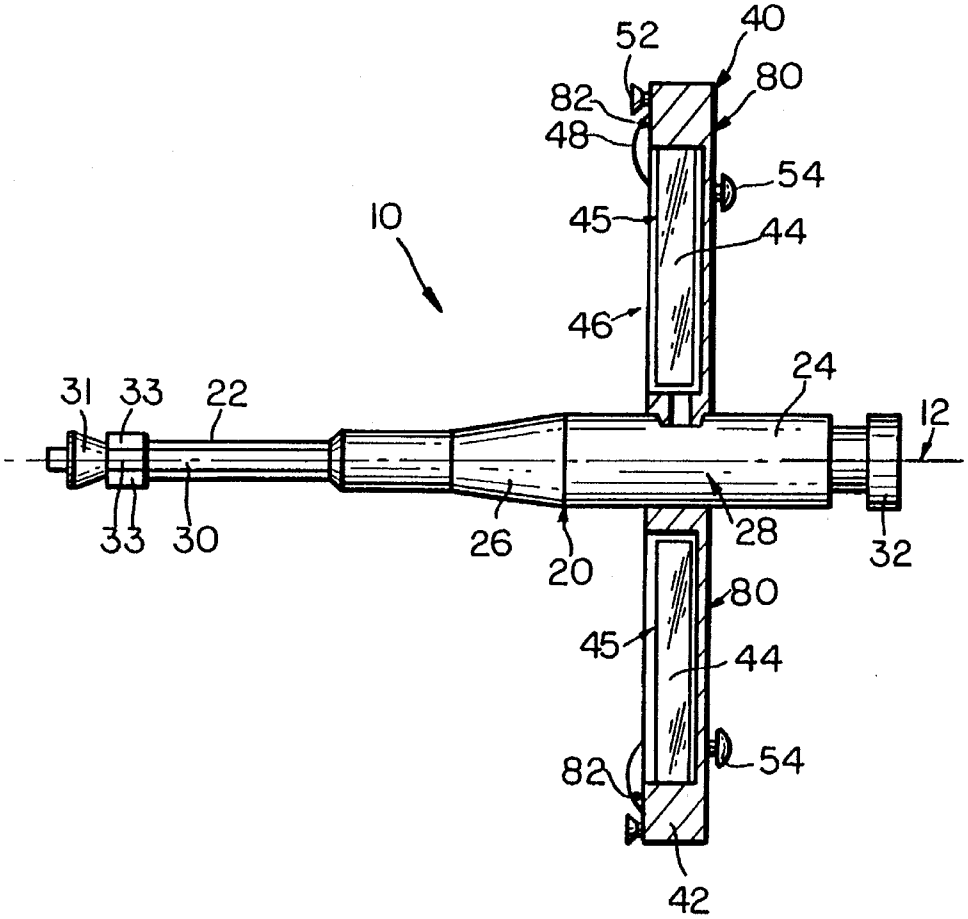
FIG. 1 is a left side elevational view of a first embodiment of a boresight assembly in accordance with the invention.
Figure 3:
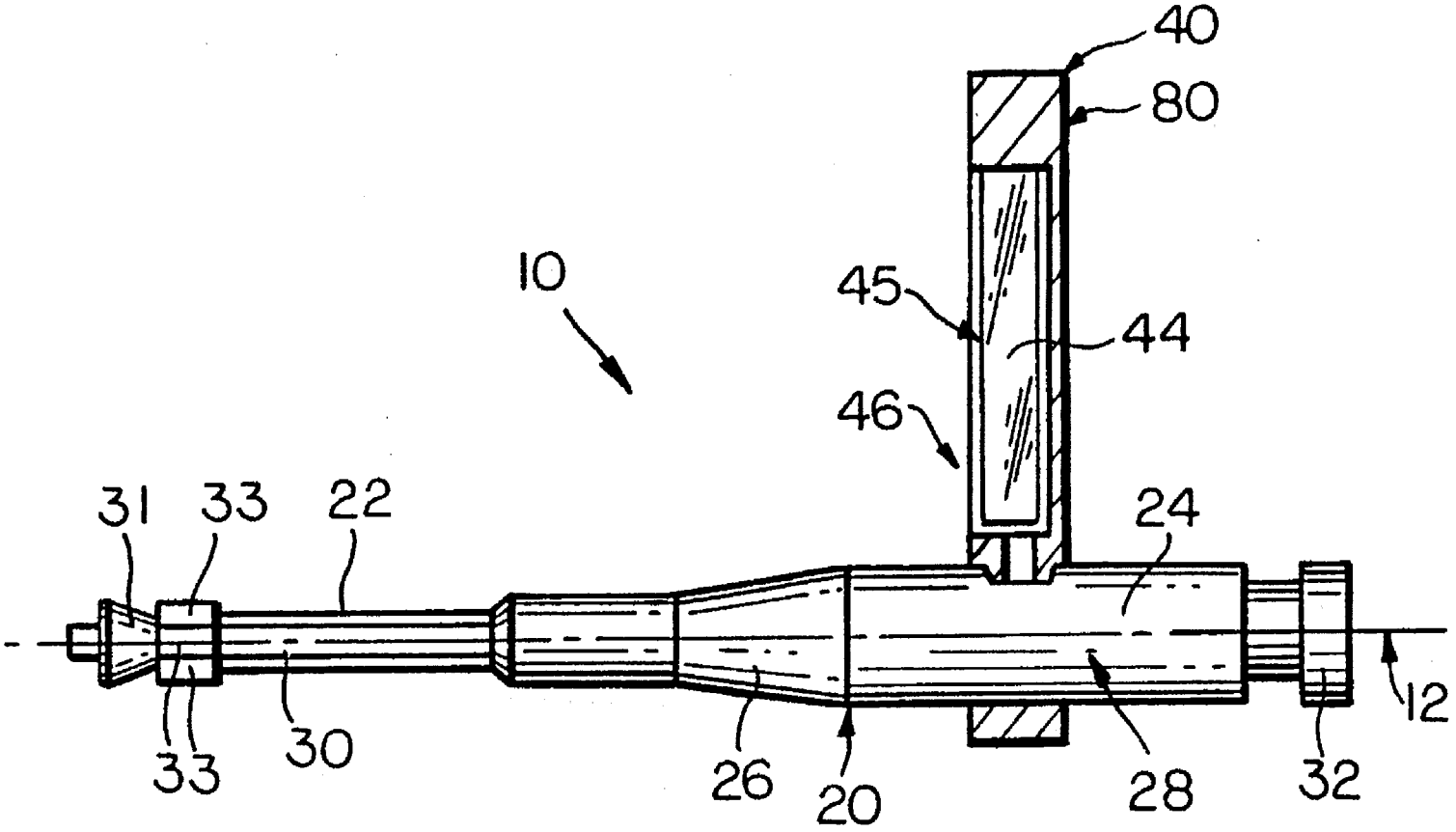
FIG. 3 is a left side elevational view of a second embodiment of a boresight assembly in accordance with the invention.

Referring first to FIGS. 1–3, the preferred embodiments of boresight assemblies made in accordance with the invention and generally designated at 10 are illustrated. Boresight assemblies 10 include a caliber rod 20 and a reflecting member 40.

Figure 4:
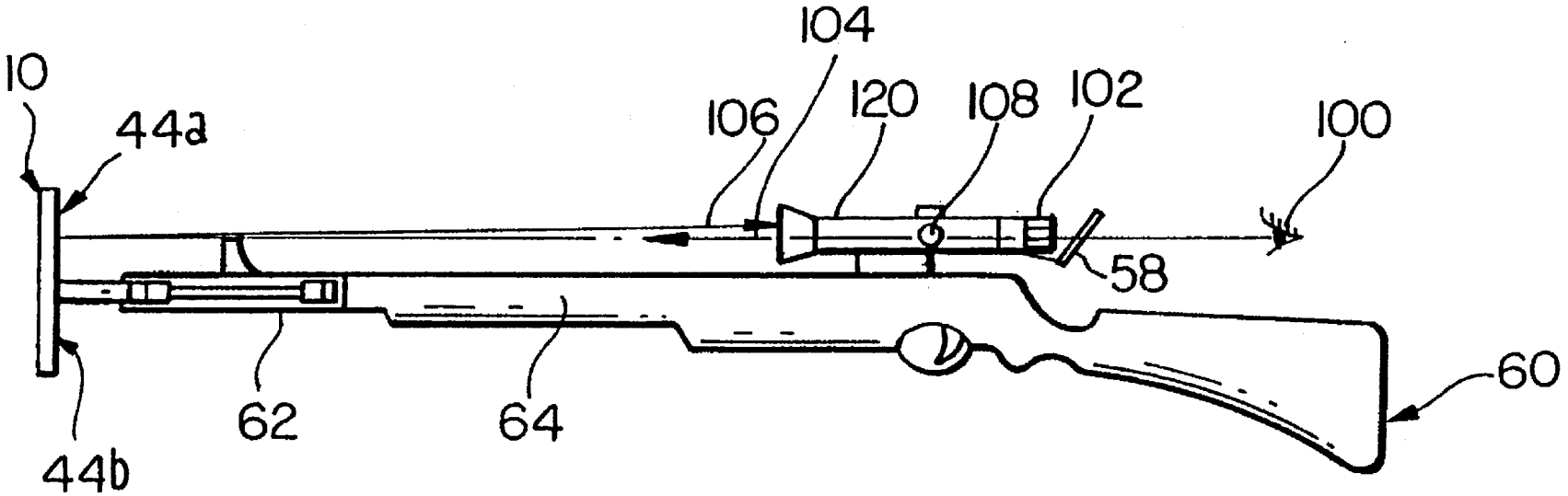
FIG. 4 is a left side elevational view of the boresight assembly of FIG. 1 inserted into the muzzle of a weapon having a telescope aiming device.

Rod 20 as seen in FIGS. 1 and 3 has a first portion 22 and a second portion 24. The outside diameter of second portion 24 is preferably designed to fit snugly within a muzzle 62 of a bore 64 of a weapon 60 (FIGS. 3 and 4). In this way, an outside surface 28 of second portion 24 bears against an inside surface (not shown) of muzzle 62.

First portion 22 of rod 20 is inserted into muzzle 62 before second portion 24. Second portion 24 is connected to first portion 22 by a variable portion 26.

In order to maintain first portion 22 of rod 20 in snug relation with the inside surface of muzzle 62, a pressure member 30 is mounted around the outside of first portion 22. Pressure member 30 may be forced against an inside surface of muzzle 62 by a spring (not shown). Pressure member 30 of FIGS. 1 and 3 is made to touch the inside surface of muzzle 62 by means of a known-in-the-art screw mechanism. The screw mechanism operates to expand pressure member 30 when the user turns handle 32 in one direction, thereby causing an angled separator member 31 to move towards handle 32. This movement of member 31 causes individual pressure elements 33 of pressure member 30 to separate and touch the inside surface of muzzle 62.

As is shown in FIGS. 1 and 2, reflecting member 40 is mounted to rod 20 around second portion 24. As will be discussed in more detail below, reflecting member 40 of FIGS. 1 and 2 essentially has two minor panels 44 having reflecting surfaces 45; a mirror panel 44*a* above rod 20 and a mirror panel 44*b* below rod 20. This dual reflecting surface structure allows boresight assembly 10 of FIGS. 1 and 2 to be self-testing for perpendicularity of reflecting surface 45 to bore 64 of weapon 60, in order to assure that alignment of weapon 60 is accurately accomplished.

Continuing with FIGS. 1 and 2, reflecting member 40 consists of a casing 42 and a mirror panel 44. Casing 42 has a first surface 80 and a second surface 82. Mirror panel 44 has a reflecting surface 45 and is held within a recessed chamber 46 of casing 42 by retaining members 48. Chamber 46 of casing 42 extends through second surface 82 of casing 42. Retaining members 48 consist of retaining clips 50, one end of each touching mirror panel 44, while the other end is attached to casing 42 by a screw 52.

As to the embodiments of FIGS. 1 and 2 and FIG. 3, mirror panel 44 may be either hard-mounted or adjustable mounted within chamber 46 of casing 42. Mirror panel 44 would be hard-mounted in order to maintain a perpendicular orientation of reflecting surface 45 to rod 20. However, since it is often desirable to have mirror panel 44 adjustable mounted, mirror panel 44 may also be mounted with adjusting means 54, for adjusting the angle of mirror panel 44 with respect to a longitudinal axis 12 of rod 20.

With respect to preferred embodiments of the invention, and for the purpose of this disclosure, the embodiment of FIGS. 1 and 2 shows an adjustable mounted mirror panel, while the embodiment of FIG. 3 shows a hard-mounted mirror panel.

The particular type of mounting of mirror panel 44 within casing 42 of reflecting member 40 is dependent upon the intended use of weapon 60. If the user needs to adjust the weapon's aiming device to be parallel to the weapon's bore, then mirror panel 44 should be perpendicular to axis 12 of rod 20; preferable within some fraction of a milliradian. Although this perpendicular mounting is the usual case, and is achieved by embodiments of both FIGS. 1 and 2 and FIG. 3, there are times when the user wants to alter the aiming of the weapon in order to correct the ballistic trajectory of the weapon's projectile (bullet). Since a bullet does not travel in a straight line, but instead drops towards the Earth due to gravity, the user of the weapon may wish to compensate for that drop by aiming above his intended target. This can be achieved by inducing a deviation from perpendicular of reflecting surface 45 of mirror panel 44 with respect to longitudinal axis 2 of rod As has been discussed above, mirror panel 44 of reflecting member 40 of the embodiment of FIGS. 1 and 2, is essentially two mirror panels 44*a* and 44*b* having dual reflecting surfaces 45*a* and 45*b*. The purpose of the dual reflecting structure is to allow boresight assembly 10 to be a self-testing unit for the perpendicularity of mirror panel 44 to axis 12 of rod 20 and, therefore, to bore 64 of weapon 60. Even if the user intends to compensate for the ballistic trajectory by using adjusting means 54, he will want mirror panel 44 to originally be perpendicular everywhere to bore 64 of weapon 60. Such overall perpendicularity ensures the ultimate accuracy of the alignment adjustments, discussed below.

Describing now in more detail the self-testing feature of boresight assembly 10 of FIGS. 1 and 2, rod 20 has a handle 32 which can be gripped by the user of weapon 60 in order to (1) insert and remove boresight assembly 10, and (2) rotate boresight assembly 10 about its axis 12. The purpose of causing assembly 10 to rotate about axis 12 is to allow mirror panels 44*a* and 44*b* to be interchangeable in their orientation either above or below rod 20. After weapon 60 has been aligned by using boresight assembly 10 (discussed in more detail below), the alignment of assembly 10 can be tested by rotating reflecting member 40 180° so that mirror panel 44*b*, which was not used to align weapon 60, is now in the position where mirror panel 44*a* was during alignment. By rotating reflecting member 40 180°, and then re-testing the alignment of weapon 60 using the steps discussed below, any disparity of mirror panel 44 from perpendicular to axis 12 will be shown.

Turning now to FIG. 3, it is seen that reflecting member 40 of boresight assembly 10 only extends above axis 12 of rod 20. Due to this, this embodiment of assembly 10 is not self-testing; since upon rotating assembly 10, mirror panel 44 above rod 20 will rotate to a position below rod 20, but there is no mirror panel originally below rod 20 which in turn rotates to a position above rod 20. However, this embodiment of assembly 10 does anticipate mirror panel 44 being either hard-mounted (as shown in FIG. 3) or adjustable mounted (not shown).

Figure 5:
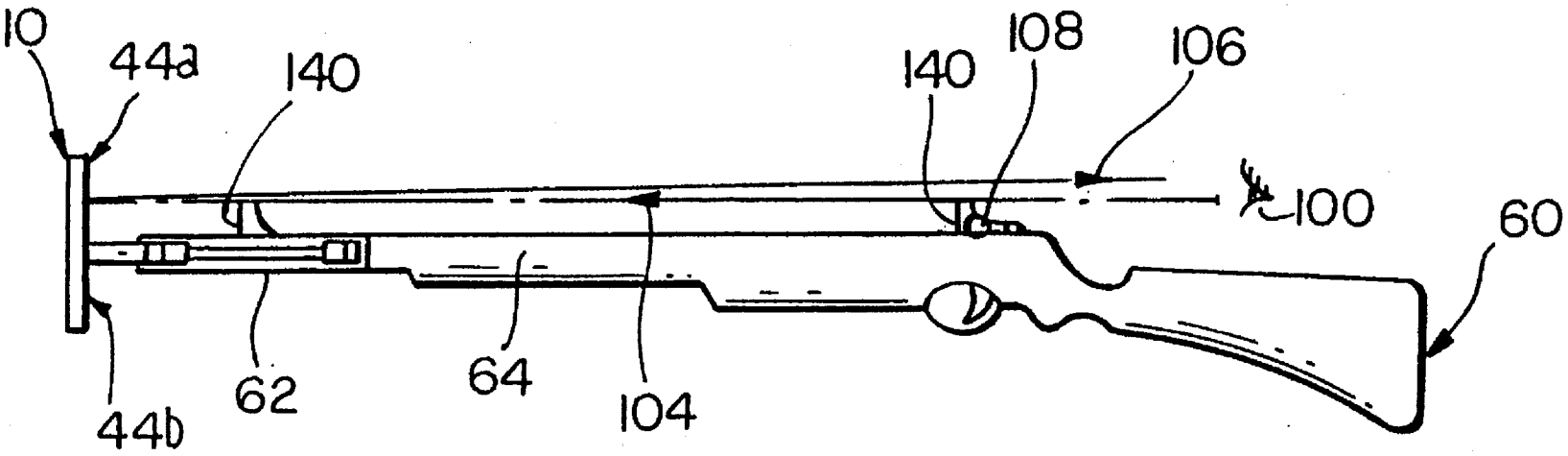
FIG. 5 is a left side elevational view of the boresight assembly of FIG. 1 inserted into the muzzle for a weapon having an alternate aiming device from that of the embodiment of FIG. 3.

Turning now to FIGS. 4 and 5, boresight 10 is seen mounted within weapons 60 (in this case rifles). Weapon 60 of FIG. 4 has a telescope aiming device 120, while weapon 60 of FIG. 5 has an iron-sight aiming device 140. Both of these aiming devices are known in the art. In operation, the embodiment of FIG. 5 achieves alignment of bore 64 of weapon 60 and iron-sight aiming device 140 of weapon 60 when user 100 looks through the v-notch (not shown) at the top of iron-sight aiming device 140 and the reflected image from mirror panel 44 (shown by arrow 106), of the v-notch (not shown) of iron-sight aiming device 140 coincides with the actual v-notch of iron-sight aiming device 140 to the eye of user 100. In like manner, as seen in FIG. 4, alignment of bore 64 of weapon 60 and telescope aiming device 120 of weapon 60 is achieved when reflected image 106 of the reticle (not shown) of telescope aiming device 120 coincides with the actual reticle (not shown), as seen by user 100 within eyepiece 102 of telescope aiming device 120.

As has been discussed, and with respect to the embodiment of FIGS. 1 and 2, the alignment of bore 64 can be tested by rotating boresight assembly 10 180° and again checking the alignment of weapon 60 using the above described alignment steps. This time, however, mirror panel 44*b* will have been rotated into the position of mirror panel 44*a* by user 100 using handle 32. With mirror panel 44*b* replacing mirror panel 44*a*, the ultimate perpendicularity of all areas of mirror panel 44 will be able to be determined, and therefore, whether the alignment of weapon 60 previously achieved was accurate.

An added feature of boresight 10, shown in the embodiment of FIG. 4, when used in connection with telescope aiming device 120, is a beam splitter 58 attached to telescope aiming device 120 in a position between the eye of user 100 and eyepiece 102 of telescope aiming device 120. Beam splitter 58 collects ambient light at eyepiece 102 and sends the ambient light through telescope aiming device 120 toward mirror panel 44 of boresight 10. In this way, the collected ambient light causes the reticle image (not shown) to be projected toward mirror panel 44 along line 104, and thereafter reflected off of mirror panel 44 back into telescope aiming device 120 along line 106, so as to be presented to the eye of user 100. It is the beam splitter action of beam splitter 58 which allows for certain light (the ambient light) to be reflected into eyepiece 102 and toward mirror panel 44, while allowing the reflected light from mirror panel 44 to travel along line 106 to pass through beam splitter 58 and ultimately to the eye of user 100.

In either of the embodiments of FIGS. 4 or 5, if the v-notch of iron-sight aiming device 140 or the reticle of telescope aiming device 120 do not correspond to their respective reflected images from mirror panel 44, adjustment of aiming devices 120 and 140 can be achieved through the use of adjustment knobs 108, as is known in the art.

Figure 6:
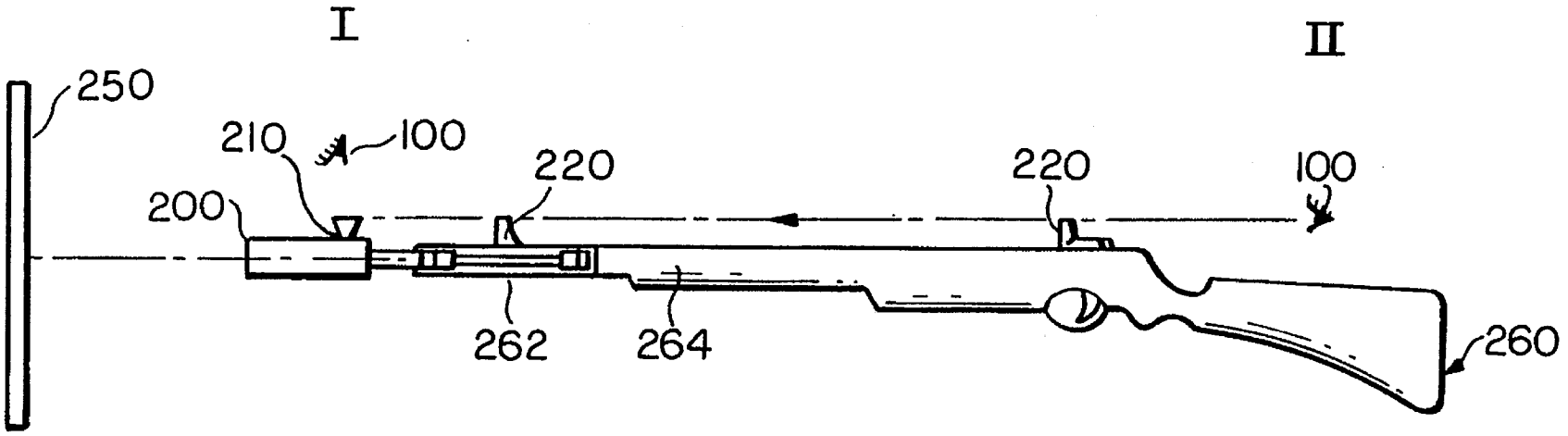
FIG. 6 PRIOR ART
FIG. 6 is a left side elevational view of a prior art boresight assembly used in connection with a weapon.

As shown in FIG. 6, prior art boresights 200 have commonly been telescope-type devices. Prior art boresights 200 are removably slidable within a muzzle 262 of a bore 264 of a weapon 260. However, since these prior art boresights 200 are not equipped with a means for reflecting an image (as in the subject invention), two disadvantages are realized: (1) an external target 250 is needed; and (2) at least a 2-position, multi-step process is required to align weapon 260.

Specifically, as shown in FIG. 6, user 100 must first choose an external target 250 at which to aim weapon 260. Once external target 250 has been chosen, weapon 260 must be fixed in place so that it does not move. User 100 will then have to position himself over boresight 200 and look down into eyepiece 210 of boresight 200 (designated position I on FIG. 6), and attempt to locate target 250. If target 250 is not seen through boresight 200. user 100 must loosen weapon 260 from its fixed position, and then, while still looking through eyepiece 210, move weapon 260, find target 250, line target 250 up in the reticle of eyepiece 210 (not shown) and then once again fix weapon 260 in place. Assuming user 100 finally fixes weapon 260 in place with external target 250 centered in the reticle of eyepiece 210 (a big assumption), he must go through the following steps. User 100 must (1) move his position from position I to position II of FIG. 6 (preferably without touching weapon 260, so as not to move it), and (2) he must then look through aiming device 220 of weapon 260 (an iron-sight aiming device for the prior art embodiment of FIG. 6) and determine whether the v-notch of aiming device 220 is centered on the same spot on external target 250, as the reticle of boresight 200. If not, user 100 must attempt to loosen aiming device 220, adjust its position and then retighten it, all without moving weapon 260. If weapon 260 moves, the entire procedure will have to be started again from the beginning.

Accordingly, it is seen that boresight assembly 10 of the subject invention is far superior to the prior art boresights 200. Specifically, the subject invention anticipates that user 100 will be able to hold weapon 60 (assuming its a gun or rifle) and, without worrying about how much weapon 60 moves, because there is no need for an external target 250, align weapon 60 through use of innovative reflecting member 40.

It will thus be seen that the objects set forth above, among those made apparent from the preceding description, are efficiently attained and, since certain changes may be made in the above constructions without departing from the spirit and scope of the invention, it is intended that all matter contained in the above description and shown in the accompanying drawing shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A boresight assembly for use by a user weapon to align said weapon, comprising:

a rod having a first longitudinal axis and being removably slidable within a bore of said weapon, said bore having a second longitudinal axis coaxial with said first longitudinal axis when said rod is within said bore; and a reflecting member extending from said rod having at least one reflecting surface, wherein said at least one reflecting surface is substantially perpendicular to both said first and second longitudinal axes through said rod and said bore, respectively.

2. A boresight assembly as recited in claim 1, said rod comprising a first cylindrical portion.

3. A boresight assembly as recited in claim 2, wherein said reflecting member extends from said first cylindrical portion of said rod.

4. A boresight assembly as recited in claim 3, wherein an outside diameter of said first cylindrical portion of said rod is substantially identical to an inside diameter of said bore of said weapon, to achieve a snug fit of said first cylindrical portion within said bore.

5. A boresight assembly as recited in claim 2, said rod further comprising a second portion extending from said first cylindrical portion in the direction of said longitudinal axis of said rod, said second portion having pressure exerting means for exerting pressure against an inside surface of said bore.

6. A boresight assembly as recited in claim 5, wherein said second portion of said rod extends further into said bore of said weapon then said first cylindrical portion of said rod, in order to help ensure that said longitudinal axis of said rod and a longitudinal axis of said bore are substantially coaxial.

7. A boresight assembly as recited in claim 1, said rod comprising handle means for said user to use when removably sliding said rod within said bore of said weapon.

8. A boresight assembly as recited in claim 1, said boresight assembly further comprising beam splitter means mounted to said weapon in a position between an eye of said user and an aiming device on said weapon for collecting and directing ambient light through said aiming device, said light to then be reflected off of said reflecting member back through said aiming device and said beam splitter means to said eye of said user.

9. A boresight assembly for use by a user of a weapon to align said weapon, comprising:

a rod having a first longitudinal axis and rotatable within a bore of said weapon, said bore having a second longitudinal axis coaxial with said first longitudinal axis of said rod, when said rod is within said bore;

a reflecting member extending from said rod at an angle substantially perpendicular to said first and second longitudinal axes, and in directions above and below said first and second longitudinal axes, said reflecting member thereby comprising a first portion in a position above said axes and a second portion in a position below said axes;

wherein said rod is rotated within said bore to reposition said first portion of said reflecting member to said position below said axis and said second portion of said reflecting member to said position above said axis.

10. A boresight assembly as recited in claim 9, said reflecting member further comprising at least one panel having a first portion at a position above said axes and a second portion at a position below said axes and at least one reflecting surface on said at least one panel.

11. A boresight assembly as recited in claim 10, said reflecting member further comprising adjusting means for adjusting an angle at which said at least one reflecting surface of said at least one panel intersects said longitudinal axis of said rod.

12. A boresight assembly as recited in claim 11, said adjusting means comprising screw means extending through a first side of said reflecting member in order to abut against a non-reflecting surface of said at least one panel, said non-reflecting surface of said at least one panel being opposite to said at least one reflecting surface.

13. A boresight assembly as recited in claim 9, said boresight assembly further comprising beam splitter means mounted to said weapon in a position between an eye of said user and an aiming device on said weapon for collecting and directing ambient light through said aiming device, said light to then be reflected off of said reflecting member back through said aiming device and said beam splitter means to said eye of said user.

14. A method of aligning an aiming device and a longitudinal axis of a weapon having a first end and a second end, with a boresight assembly, said boresight assembly having a rod removably slidable within a bore of said weapon at said first end of said weapon, said rod having a first longitudinal axis which is coaxial with a second longitudinal axis of said bore when said rod is within said bore, and said boresight assembly further having a reflecting member extending from said rod substantially perpendicularly to said first and second axes, comprising the steps of:

inserting said rod into said bore so that a reflecting surface of said reflecting member faces said second end of said weapon;

sighting through said aiming device of said weapon by looking from said aiming device to said reflecting surface of said reflecting member; and observing whether a reflected image of said aiming device and said aiming device coincide.

15. A method of aligning an aiming device and a longitudinal axis of a weapon with a boresight assembly as recited in claim 14, further comprising the step of adjusting said aiming device if said reflected image of said aiming device and said aiming device do not coincide, until said image of said aiming device and said aiming device coincide.

16. A method of testing the alignment of a boresight assembly, said boresight assembly comprising a rod rotatable within a bore of a weapon at a first end of said weapon, said rod having a first longitudinal axis which is coaxial with a second longitudinal axis of said bore when said rod is within said bore, and said boresight assembly further having at least one reflecting surface extending from said rod in directions above and below said longitudinal axis of said rod, comprising the steps of:

aligning an aiming device of said weapon to said second longitudinal axis of said bore using a first portion of said at least one reflecting surface above said second longitudinal axis;

rotating said rod so that a second portion of said at least one reflecting surface below said second longitudinal axis rotates to said position above said second longitudinal axis; and testing said alignment of said boresight assembly using said second portion of said at least one reflecting surface, said boresight assembly being aligned when said at least one reflecting surface is substantially perpendicular to said first and second longitudinal axes.

17. A method of testing the alignment of a boresight assembly as recited in claim 16, said aligning step further comprising the steps of:

inserting said rod into said bore so that said first portion of said at least one reflecting surface faces a second end of said weapon opposite said first end;

sighting through said aiming device of said weapon by looking from said aiming device to said first portion of said at least one reflecting surface; and observing whether a first reflected image of said aiming device and said aiming device coincide. one mirror panel faces a second end of said weapon opposite said first end;

sighting through said aiming device of said weapon by looking from said aiming device to said first portion of said at least one mirror panel; and observing whether a first reflected image of said aiming device and said aiming device coincide.

18. A method of testing the alignment of a boresight assembly as recited in claim 17, said aligning step further comprising the step of adjusting said aiming device if said reflected image of said aiming device and said aiming device do not coincide, until said image of said aiming device and said aiming device coincide.

19. A method of testing the alignment of a boresight assembly as recited in claim 17, said testing step further comprising the steps of:

sighting through said aiming device of said weapon by looking from said aiming device to said second portion of said at least one reflecting surface; and observing whether a second reflected image of said aiming device and said aiming device coincide.

* * * * *